US009357622B2

(12) United States Patent
Gumaer

(10) Patent No.: US 9,357,622 B2
(45) Date of Patent: May 31, 2016

(54) WIRELESS CONFIGURATION AND DIAGNOSTICS OF AIRFIELD LIGHTING FIXTURES

(71) Applicant: Traver Gumaer, Easthampton, MA (US)

(72) Inventor: Traver Gumaer, Easthampton, MA (US)

(73) Assignee: Cooper Technologies Company, Houston, TX (US)

( * ) Notice: Subject to any disclaimer, the term of this patent is extended or adjusted under 35 U.S.C. 154(b) by 0 days.

(21) Appl. No.: 14/684,097

(22) Filed: Apr. 10, 2015

(65) Prior Publication Data

US 2015/0296600 A1 Oct. 15, 2015

Related U.S. Application Data

(60) Provisional application No. 61/978,040, filed on Apr. 10, 2014.

(51) Int. Cl.
*H05B 37/02* (2006.01)

(52) U.S. Cl.
CPC ..... *H05B 37/0272* (2013.01)

(58) Field of Classification Search
None
See application file for complete search history.

(56) References Cited

U.S. PATENT DOCUMENTS

| | | | | |
|---|---|---|---|---|
| 5,105,124 | A | 4/1992 | Futsuhara et al. | |
| 5,397,963 | A | 3/1995 | Manson | |
| 5,644,304 | A | 7/1997 | Pavarotti et al. | |
| 5,926,115 | A | 7/1999 | Schleder et al. | |
| 5,969,642 | A | 10/1999 | Runyon et al. | |
| 7,023,361 | B1 | 4/2006 | Wallace et al. | |
| 7,102,540 | B2 | 9/2006 | Runyon et al. | |
| 7,123,140 | B1 | 10/2006 | Denes | |
| 7,646,029 | B2 * | 1/2010 | Mueller | F21K 9/00 257/13 |
| 8,060,262 | B2 | 11/2011 | Burgin et al. | |
| 8,174,408 | B2 | 5/2012 | Johnston et al. | |
| 8,278,845 | B1 | 10/2012 | Woytowitz | |
| 8,284,751 | B2 | 10/2012 | Kock | |
| 8,742,680 | B2 * | 6/2014 | Cowburn | H05B 37/0254 315/132 |
| 2002/0163447 | A1 * | 11/2002 | Runyon | H05B 37/0272 340/947 |
| 2005/0225976 | A1 * | 10/2005 | Zampini | B63B 45/04 362/227 |
| 2008/0137181 | A1 | 6/2008 | That et al. | |

(Continued)

FOREIGN PATENT DOCUMENTS

WO 2009074913 6/2009

OTHER PUBLICATIONS

O. Tsykanovskaya, International Search Report and Written Opinion of International Application No. PCT/US2015/025447, completed May 18, 2015, mailed Jun. 10, 2015, 7 pages, Federal Institute of Industrial Property, Moscow.

*Primary Examiner* — Crystal L Hammond
(74) *Attorney, Agent, or Firm* — King & Spalding LLP

(57) ABSTRACT

The present disclosure relates to a system and method for wirelessly configuring and diagnosing an airfield lighting system. In particular, the system can include a constant current regulator that comprises a wireless communication interface. The system can also include a plurality of light fixtures where one or more of the light fixtures includes a wireless communication interface. The constant current regulator and the light fixture can communicate via the wireless communication interfaces with a handheld wireless device. Alternatively, the constant current regulator and the light fixture can communicate via the wireless communication interfaces with wireless display devices. The wireless communication interfaces can communicate configuration and diagnostic information.

18 Claims, 4 Drawing Sheets

(56) References Cited

U.S. PATENT DOCUMENTS

2011/0121654 A1* 5/2011 Recker ..... H05B 37/0272 307/66
2012/0043889 A1* 2/2012 Recker ..... H05B 33/0815 315/86
2012/0080944 A1* 4/2012 Recker ..... H02J 9/02 307/25
2012/0189298 A1 7/2012 Ohad et al.
2012/0245880 A1* 9/2012 Nabrotzky ..... G01R 31/086 702/122
2012/0310703 A1 12/2012 Cavalcanti et al.
2013/0147389 A1 6/2013 Hoffer, Jr. et al.
2014/0028200 A1* 1/2014 Van Wagoner ..... H05B 37/0272 315/158
2014/0042923 A1 2/2014 Yu
2015/0009204 A1* 1/2015 Chaji ..... G09G 3/3233 345/214

* cited by examiner

WIRELESS CONFIGURATION AND DIAGNOSTICS OF AIRFIELD LIGHTING FIXTURES

RELATED APPLICATIONS

The present application claims priority under 35 U.S.C. §119(e) to U.S. provisional patent application No. 61/978,040, titled "Wireless Configuration and Diagnostics of Airfield Lighting Fixtures," filed on Apr. 10, 2014, the entire content of which is incorporated herein by reference.

TECHNICAL FIELD

Embodiments of the invention relate generally to wirelessly configuring and diagnosing airfield lighting systems. More specifically, present embodiments relate to an airfield lighting system that can be controlled and monitored via wireless devices.

BACKGROUND

Typically, modern airfield lighting fixtures, guidance devices, and control system components have complicated electronic hardware that must be configured after installation. Additionally, these devices may require troubleshooting or repair during operation. Many such airfield devices are solidly mounted in the ground, and access to the electronics of the devices requires partially disassembling or removing the devices. Thus, configuration and troubleshooting of these devices and the associated circuitry often requires an operator to manually interact with the devices and inspect the hardware. The airfield lighting system may need to be taken offline and a portion of the airfield may be closed off during such situations. Configuring and troubleshooting airfield devices in this manner results in loss of time, man-hours, and decreased utilization of the airfield.

SUMMARY

In general, in one aspect, the present disclosure relates to a wireless capable airfield lighting system comprising a wireless capable constant current regulator with a first wireless communication interface and one or more wireless capable light fixtures with a second wireless communication interface. The one or more wireless capable light fixtures are powered by the constant current regulator. The first wireless communication interface transmits data regarding at least one condition of the wireless capable CCR to a wireless device. The second wireless communication interface transmits data regarding at least one condition of the one or more wireless capable light fixtures to the wireless device.

In another aspect, the present disclosure relates to a wireless capable airfield lighting system comprising a wireless capable constant current regulator with a first wireless communication interface and one or more wireless capable light fixtures with a second wireless communication interface. The one or more wireless capable light fixtures are powered by the constant current regulator. The first wireless communication interface transmits data regarding at least one condition of the wireless capable CCR to a first wireless display. The second wireless communication interface transmits data regarding at least one condition of the one or more wireless capable light fixtures to a second wireless display.

These and other objects and aspects will be described in greater detail in the example embodiments provided in the following disclosure.

BRIEF DESCRIPTION OF THE FIGURES

The drawings illustrate only example embodiments of airfield lighting systems and are therefore not to be considered limiting of its scope, as airfield lighting systems may admit to other equally effective embodiments. The elements and features shown in the drawings are not necessarily to scale, emphasis instead being placed upon clearly illustrating the principles of the example embodiments. Additionally, certain dimensions or positionings may be exaggerated to help visually convey such principles. In the drawings, reference numerals designate like or corresponding, but not necessarily identical, elements.

DETAILED DESCRIPTION OF EXAMPLE EMBODIMENTS

Example embodiments disclosed herein are directed to systems and methods of configuring and diagnosing an airfield lighting system or light fixture wirelessly. Specifically, an airfield lighting system is coupled with various sensors and processors which collect various operational data regarding the system. Such data is transmitted to a remote device via a wireless communication interface. The collected data can be accessed via the remote device. Thus, manual interaction with the airfield lighting system and its electrical components is not required to acquire such data. Additionally, the remote device can also transmit certain control commands to the airfield lighting system via the wireless communication interface, which configure the system accordingly. The remote device may be a display wirelessly coupled to the airfield lighting system which displays the data regarding the system. Although example embodiments of the present disclosure are illustrated using an airfield lighting system and light fixtures, the techniques provided herein also provide a means of configuring and diagnosing other components of an airfield lighting system and its circuitry.

Figure 1:
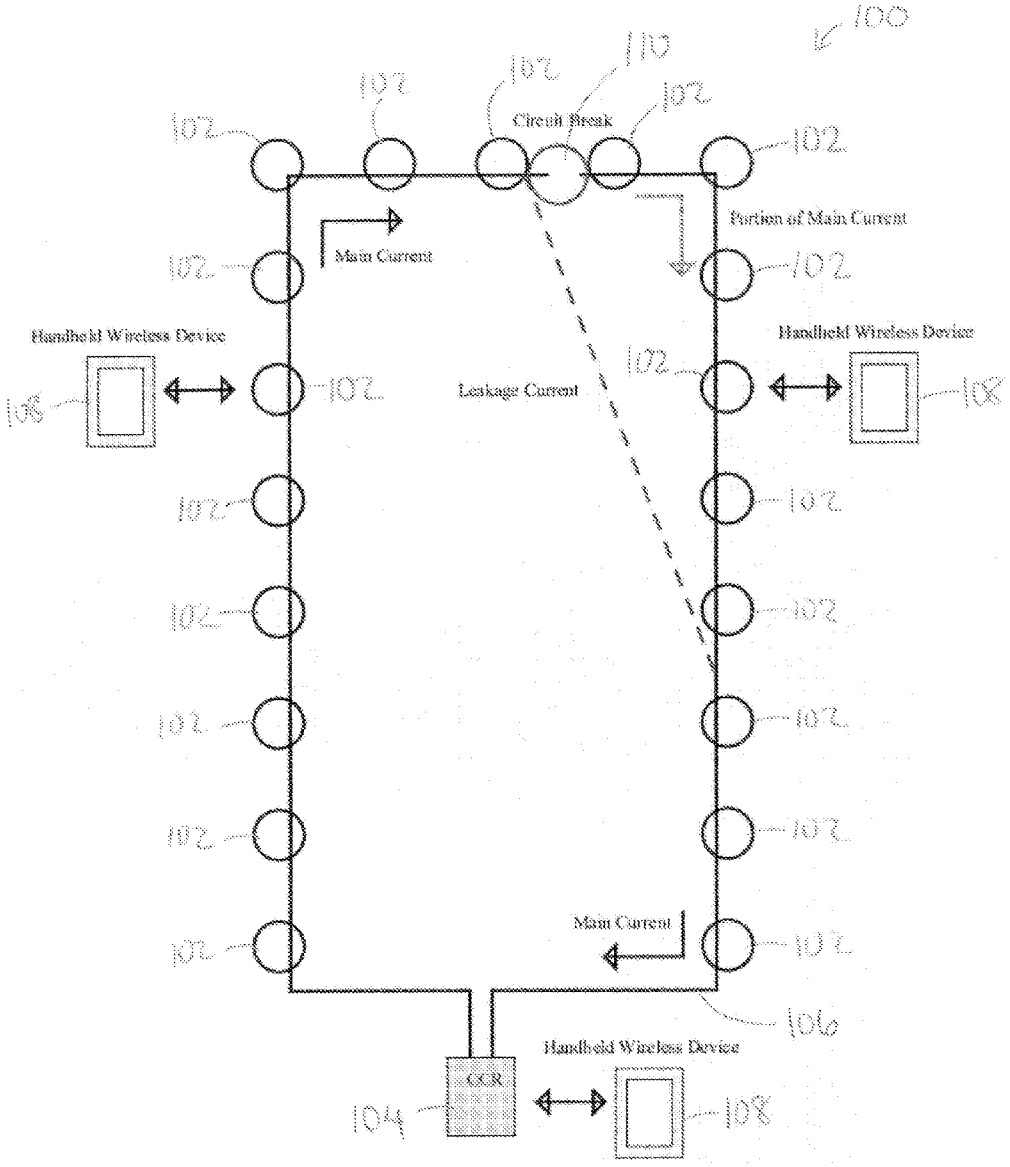
FIG. 1 illustrates a diagrammatical representation of a wireless capable airfield lighting system with wireless configuration and diagnostics, in accordance with example embodiments of the present disclosure.

FIG. 1 illustrates a diagrammatical representation of a wireless capable airfield lighting system 100 with wireless configuration and diagnostics, in accordance with example embodiments of the present disclosure. Referring to FIG. 1, the wireless capable airfield lighting system 100 includes a plurality of light fixtures 102 coupled within a circuit 106 and powered by a constant current regulator (CCR) 104. As is known in the field of airport lighting, airfield lighting systems require a constant current which is controlled by a CCR. The CCR receives power from the power grid or an alternate power source and provides a constant current to the airfield lighting system. In certain example embodiments, all or a portion of the lighting fixtures 102 are wirelessly communicable with a wireless device 108. In certain example embodiments, the wireless device 108 receives data from the light fixtures 102 regarding certain operational conditions, such as voltage, current, temperature, blink rate and other applicable data. Furthermore, in certain example embodiments, the wireless device 108 is configured to send control commands to the light fixtures 102. The control commands can change one or more operational parameters of the light fixtures 102, identify, or otherwise configure the light fixtures 102. In certain example embodiments, the CCR 104 is also wirelessly communicable with the same or a different wireless device 108. Thus, the wireless device 108 can monitor conditions of the CCR 104 such as power input and output. In certain example embodiments, the wireless device 108 can collect data from all of the light fixtures 102 as well as the CCR 104, and thereby identify issues within the entire circuit 106.

FIG. 1 further illustrates an example diagnostic situation in the wireless capable airfield lighting system 100. Specifically, in this example, there is a circuit break 110 in the series circuit 106. This may have been caused by general circuit wear over time or an event such as nearby construction or other disturbance, which resulted in physical damage to the circuit 106. In many such cases, the light fixtures 102 may remain lit because the electrical current will find an alternative path in the ground. However, the light fixtures 102 will generally not receive the proper current level, and the loose electrical current in the ground may cause other undesired disturbances. With the wireless diagnostic capabilities enabled by the airfield lighting system 100, each light fixture 102 is able to transmit the current level that it sees to the wireless device 108. Thus, an operator does not need to manually take the current measurement of the light fixture 102 or the circuit 106. The wireless device 108 can also receive data from the CCR 104 indicative of the current level being supplied. Thus, if there is a significant differential between the current supplied by the CCR 104 and the current seen at the light fixture 102, a potential issue is detected.

Potential circuit or system issues which may not be visually obvious can also be detected through the wireless capable airfield lighting system 100. For example, a current leakage scenario similar to that illustrated above and with reference to FIG. 1 may produce only a small drop in current in the affected light fixtures 102. Thus, the resulting brightness change may not be noticeable by the human eye. However, a periodic survey of the current levels of the light fixtures 102 via the wireless device 108 can identify such issues. Furthermore, in certain example embodiments, the wireless device 108 is configured to periodically monitor the current levels of the light fixtures 102 and produce an alert when current levels fall out of range, indicating potential issues in the circuit 106. Additionally, depending on the readings from each of the light fixtures 102, the wireless device 108 may also help locate the source of the issue. In certain example embodiments, many data points regarding the overall condition of the circuit 106, system 100, and light fixtures 102 can be collected and used to monitor for potential issues or for trouble shooting. In addition to monitoring and diagnosing the system 100, in certain example embodiments, the wireless device 108 can also send signals to the light fixtures 102, CCR 104, or other communicative components of the system 100. In this fashion, the wireless device 108 is capable of controlling various operational parameters of the system 100 and configuring the light fixtures 102, CCR 104, or other components.

Figure 2:
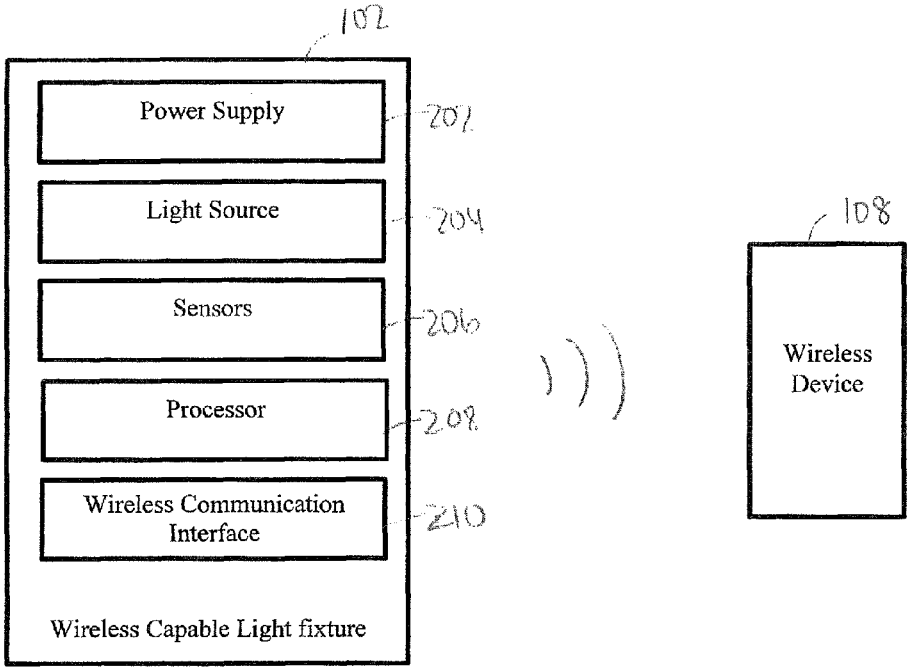
FIG. 2 illustrates a wireless capable airfield light fixture with wireless configuration and diagnostics, in accordance with example embodiments of the present disclosure.

FIG. 2 illustrates a diagrammatical representation of the wireless capable airfield light fixture 102 with wireless configuration and diagnostics, in accordance with example embodiments of the present disclosure. In certain example embodiments, the light fixture 102 includes a power supply 202, a light source 204, one or more sensors 206, a processor 208, and a wireless communication interface 210. The sensors 206 are configured to sense various conditions such as the current, voltage, temperature, blink rate, and the like. The processor 208 receives the raw data from the sensors 206 and processes the raw data into an end-user data format and transmits the data to the wireless device 108 via the wireless communication interface 210. In certain example embodiments, each light fixture 102 can comprise a wireless communication interface 210. However, in alternate embodiments of airfield lighting system 100, a wireless communication interface 210 may only be located in some but not all of the light fixtures 102 in system 100 and the wireless communication interface 210 may collect and communicate data on behalf of several light fixtures 201. In certain example embodiments, the wireless communication interface 210 utilizes Bluetooth communication protocol. In certain other example embodiments, the wireless communication interface 210 utilizes radio frequency communication, wifi, or any other appropriate wireless communication protocol. In certain example embodiments, the wireless device 108 is a mobile device such as a smartphone, a tablet, or a specialized handheld device. In certain example embodiments, the wireless device 108 may be a more substantial computing device such as a laptop or desktop computer, or other designated device.

Figure 3:
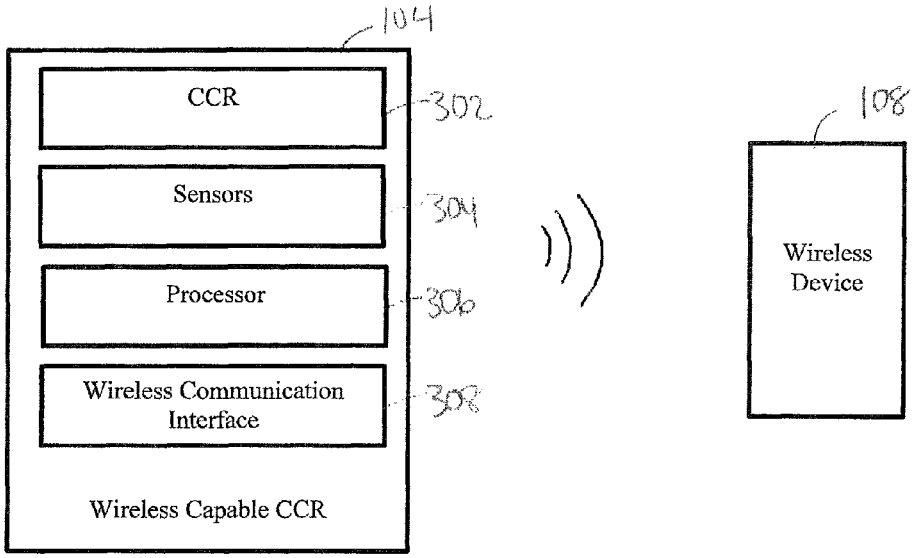
FIG. 3 illustrates a wireless capable airfield CCR system with wireless configuration and diagnostics, in accordance with example embodiments of the present disclosure.

FIG. 3 illustrates a wireless capable CCR 104 with wireless configuration and diagnostics, in accordance with example embodiments of the present disclosure. In certain example embodiments, the wireless capable CCR 104 includes a CCR 302 such as a traditional CCR, one or more sensors 304, a processor 306, and a wireless communication interface 308. In certain example embodiments, the sensors 304 are configured to sense various conditions such as input power, output current, and the like. The processor 306 receives the raw data from the sensors 304 and processes the raw data into an end-user data format and transmits the data to the wireless device 108 via the wireless communication interface 308. A wireless capable CCR, such as CCR 104, also provides safety advantages in that data can be collected and transmitted to the CCR without coming into direct contact with the electrical components of the CCR.

Figure 4:
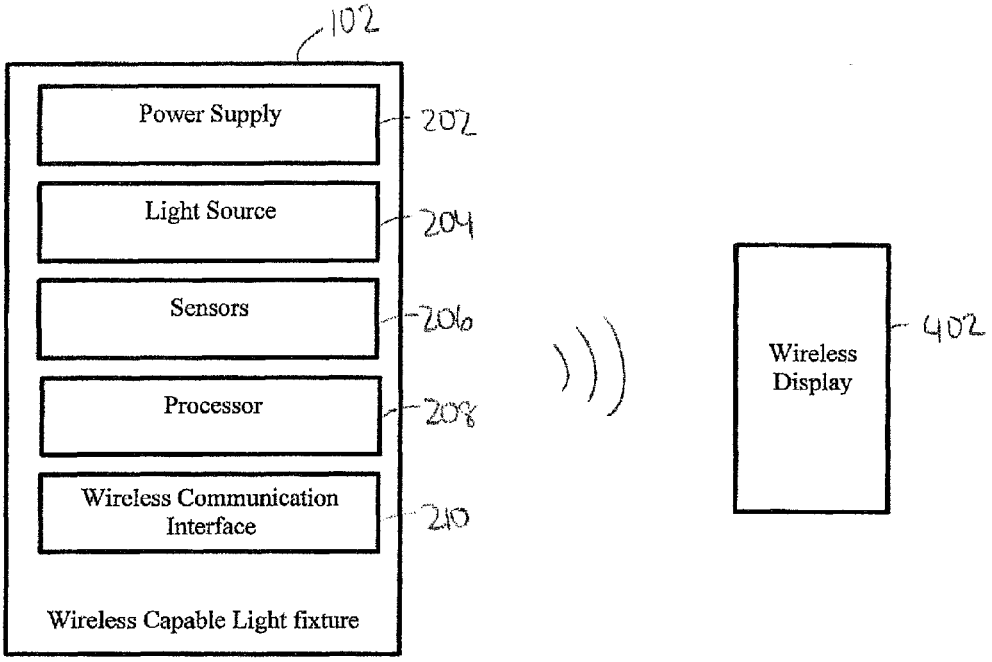
FIG. 4 illustrates a wireless capable airfield light fixture with a wireless display, in accordance with example embodiments of the present disclosure.
Figure 5:
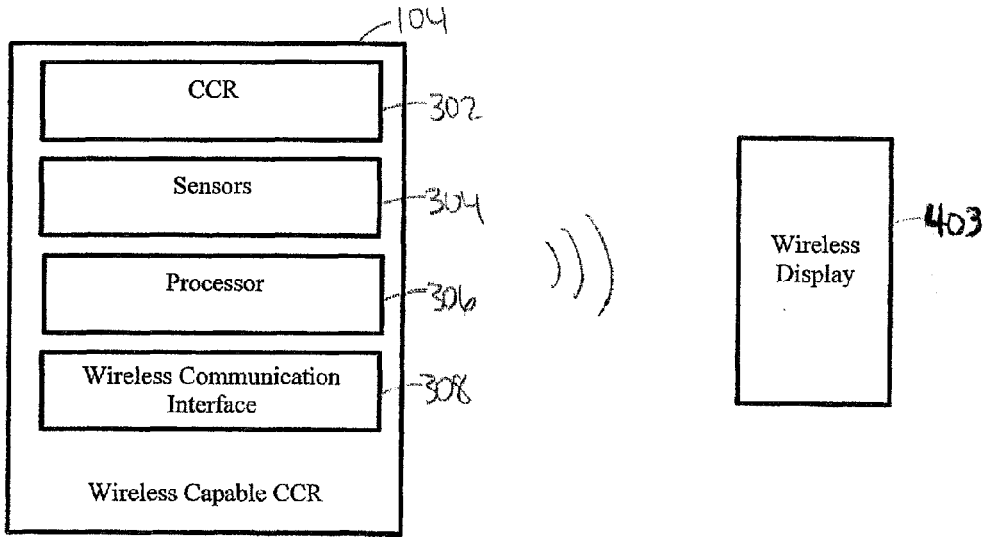
FIG. 5 illustrates a wireless capable airfield CCR system with a wireless display, in accordance with example embodiments of the present disclosure.

FIG. 4 illustrates a wireless capable light fixture 102 with a wireless display 402, in accordance with example embodiments of the present disclosure. In certain example embodiments, the wireless display 402 is configured to display various data regarding the operation or health of the light fixture 102, system 100, or circuit 106. In one example embodiment, the wireless display 402 can receive and display data regarding the condition of a plurality of light fixtures 102 in the system 100. In certain example embodiments, the wireless display 402 is a detachable display mounted near a light fixture 102. In certain other example embodiments, the wireless display 402 may be located remotely from the light fixture 102 such as a designated display area or control center. In certain example embodiments, the wireless display 402 comprises a tablet or a specialized display such as a LED or LCD display. Similarly, FIG. 5 illustrates a wireless capable CCR 104 with a wireless display 403, in accordance with example embodiments of the present disclosure. The wireless display 403 is configured to display various data regarding the operation or health of the wireless capable CCR 104, including the current the CCR supplies to the system 100. The wireless display 403 can be mounted proximate to or attached to the wireless capable CCR 104. In certain embodiments, the wireless display 403 can be detachably mounted to the wireless capable CCR 104.

Figure 6:
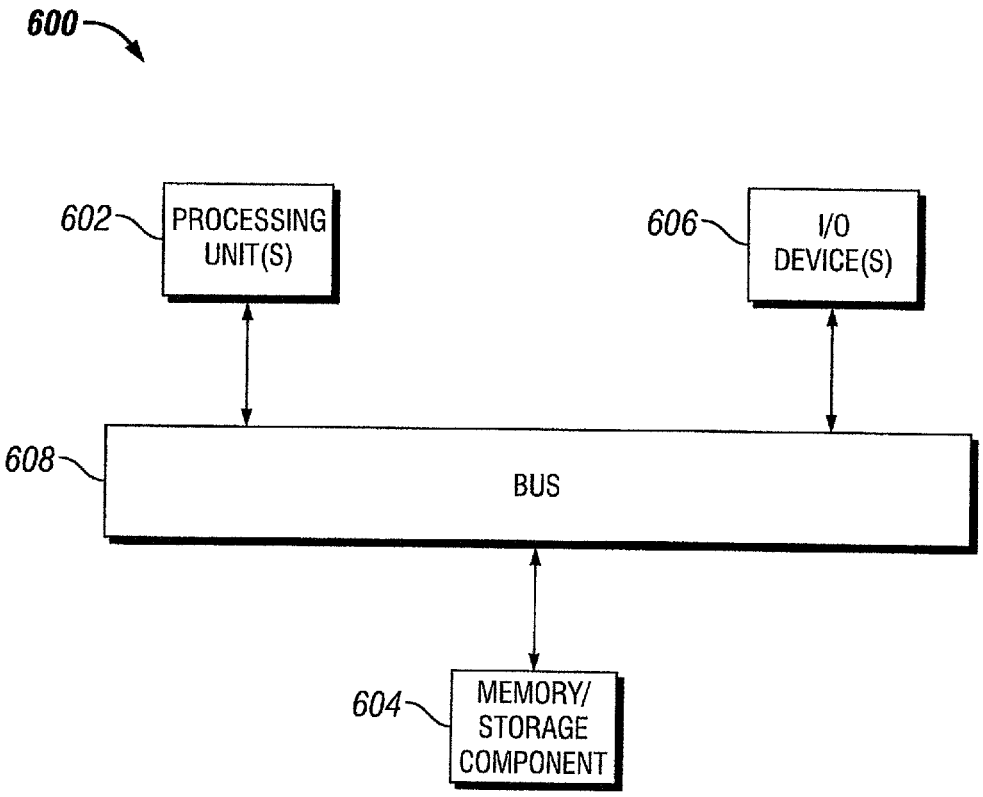
FIG. 6 illustrates an example computing device that can be implemented with the example embodiments described herein.

FIG. 6 illustrates one embodiment of a computing device 600 that implements one or more of the various techniques described herein, and which is representative, in whole or in part, of the elements described herein pursuant to certain example embodiments. For example, computing device 600 can be implemented as one or more of the wireless devices 108 or the wireless displays 402 and 403. Additionally, processing unit 602 can be implemented for any of the previously described processors 208 and 306 in conjunction with the other components shown in FIG. 6. Computing device 600 is one example of a computing device and is not intended to suggest any limitation as to scope of use or functionality of the computing device and/or its possible architectures. Neither should computing device 600 be interpreted as having any dependency or requirement relating to any one or combination of components illustrated in the example computing device 600.

Computing device 600 includes one or more processors or processing units 602, one or more memory/storage components 604, one or more input/output (I/O) devices 606, and a bus 608 that allows the various components and devices to communicate with one another. Bus 608 represents one or more of any of several types of bus structures, including a memory bus or memory controller, a peripheral bus, an accelerated graphics port, and a processor or local bus using any of a variety of bus architectures. Bus 608 includes wired and/or wireless buses. Memory/storage component 604 represents one or more computer storage media. Memory/storage component 604 can include volatile media (such as random access memory (RAM)) and/or nonvolatile media (such as read only memory (ROM), flash memory, optical disks, magnetic disks, and so forth). Memory/storage component 604 can include fixed media (e.g., RAM, ROM, a fixed hard drive, etc.) as well as removable media (e.g., a Flash memory drive, a removable hard drive, an optical disk, and so forth).

One or more I/O devices 606 allow an engineer, technician, or other user to enter commands and information to computing device 600, and also allow information to be presented to the customer, utility, or other user and/or other components or devices. Examples of input devices include, but are not limited to, a keyboard, a cursor control device (e.g., a mouse), a microphone, a touchscreen, and a scanner. Examples of output devices include, but are not limited to, a display device (e.g., a monitor or projector), speakers, a printer, and a network card.

Various techniques are described herein in the general context of software or program modules. Generally, software includes routines, programs, objects, components, data structures, and so forth that perform particular tasks or implement particular abstract data types. An implementation of these modules and techniques are stored on or transmitted across some form of computer readable media. Computer readable media is any available non-transitory medium or non-transitory media that is accessible by a computing device. By way of example, and not limitation, computer readable media includes "computer storage media".

"Computer storage media" and "computer readable medium" include volatile and non-volatile, removable and non-removable media implemented in any method or technology for storage of information such as computer readable instructions, data structures, program modules, or other data. Computer storage media include, but are not limited to, computer recordable media such as RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which is used to store the desired information and which is accessible by a computer.

The computer device 600 can be connected to a network (not shown) (e.g., a local area network (LAN), a wide area network (WAN) such as the Internet, or any other similar type of network) via a network interface connection (not shown) according to some example embodiments. Generally speaking, the computer system 600 includes at least the minimal processing, input, and/or output means necessary to practice one or more embodiments.

Although the inventions are described with reference to example embodiments, it should be appreciated by those skilled in the art that various modifications are well within the scope of the invention. From the foregoing, it will be appreciated that an embodiment of the present invention overcomes the limitations of the prior art. Those skilled in the art will appreciate that the present disclosure is not limited to any specifically discussed application and that the embodiments described herein are illustrative and not restrictive. From the description of the example embodiments, equivalents of the elements shown therein will suggest themselves to those skilled in the art, and ways of constructing other embodiments of the present disclosure will suggest themselves to practitioners of the art. Therefore, the scope of the present disclosure is not limited by the examples provided herein.

What is claimed is:

1. A wireless capable airfield lighting system, comprising:

a wireless capable constant current regulator (CCR) configured to provide constant current to a plurality of wireless capable light fixtures and comprising a processor, a first wireless communication interface, and a sensor configured to measure at least one of an input power and current output from the wireless capable CCR;

the plurality of wireless capable light fixtures electrically coupled to each other and with the wireless capable CCR such that the plurality of wireless capable light fixtures are powered by the wireless capable CCR, each of the plurality of wireless capable light fixtures comprising a second wireless communication interface; and a wireless device that is communicatively coupled to the wireless capable CCR and the plurality of wireless capable light fixtures to receive information from and transmit commands to the wireless capable CCR and the plurality of wireless capable light fixtures over one or more wireless communication paths, wherein the first wireless communication interface transmits data regarding at least one condition of the wireless capable CCR to the wireless device, and wherein the second wireless communication interface transmits data regarding at least one condition of one or more of the plurality of wireless capable light fixtures to the wireless device.

2. The wireless capable airfield lighting system of claim 1, wherein the first wireless communication interface is configured to receive a command signal from the wireless device, the command signal configuring one or more aspects of the wireless capable CCR.

3. The wireless capable airfield lighting system of claim 1, wherein the second wireless communication interface is configured to receive a command signal from the wireless device, the command signal configuring one or more aspects of the one or more of the plurality of wireless capable light fixtures.

4. The wireless capable airfield lighting system of claim 1, wherein the at least one condition of the wireless capable CCR comprises a current the CCR supplies to the wireless capable airfield lighting system.

5. The wireless capable airfield lighting system of claim 1, wherein the at least one condition of one or more of the plurality of wireless capable light fixtures comprises a voltage, a current, a temperature, and a blink rate.

6. The wireless capable airfield lighting system of claim 1, wherein each of the plurality of wireless capable light fixtures further comprise a power supply, a light source, a sensor, and a processor.

7. The wireless capable airfield lighting system of claim 1;

wherein the plurality of wireless capable light fixtures comprise a first light fixture providing a first measurement of current received at the first light fixture to the wireless device and the wireless capable CCR providing a second measurement of current supplied by the wireless capable CCR to the wireless device, and wherein the wireless device determines whether a current leakage condition exists by comparing the first measurement of current received at the first light fixture and the second measurement of current supplied by the wireless capable CCR.

8. The wireless capable airfield lighting system of claim 1, wherein the plurality of wireless capable light fixtures are mounted in an airfield.

9. The wireless capable airfield lighting system of claim 1, wherein the wireless device is a detachable display.

10. A wireless capable airfield lighting system, comprising:

a first wireless display;

a second wireless display;

a wireless capable constant current regulator (CCR) configured to provide constant current to a plurality of wireless capable light fixtures and comprising a processor, a first wireless communication interface, and a sensor configured to measure at least one of an input power and current output from the wireless capable CCR, the first wireless communication interface in communication with the first wireless display; and the plurality of wireless capable light fixtures electrically coupled to each other and with the wireless capable CCR such that the plurality of wireless capable light fixtures are powered by the wireless capable CCR, each of the plurality of wireless capable light fixtures comprising a second wireless communication interface, the second wireless communication interface in communication with the second wireless display;

wherein the first wireless communication interface transmits data regarding at least one condition of the wireless capable CCR to the first wireless display, and wherein the second wireless communication interface transmits data regarding at least one condition of one or more of the plurality of wireless capable light fixtures to the second wireless display.

11. The wireless capable airfield lighting system of claim 10, wherein the first wireless display is mounted proximate to the wireless capable CCR.

12. The wireless capable airfield lighting system of claim 10, wherein the first wireless display is detachably mounted to the wireless capable CCR.

13. The wireless capable airfield lighting system of claim 10, wherein the second wireless display is mounted proximate to the plurality of wireless capable light fixtures.

14. The wireless capable airfield lighting system of claim 10, wherein the second wireless display receives data regarding at least one condition of one or more of the plurality of wireless capable light fixtures.

15. The wireless capable airfield lighting system of claim 14, wherein the second wireless display displays a comparison of the data regarding at least one condition of the plurality of wireless capable light fixtures.

16. The wireless capable airfield lighting system of claim 10, wherein the at least one condition of the wireless capable CCR comprises a current the CCR supplies to the wireless capable airfield lighting system.

17. The wireless capable airfield lighting system of claim 10, wherein the at least one condition of one or more of the plurality of wireless capable light fixtures comprises a voltage, a current, a temperature, and a blink rate.

18. The wireless capable airfield lighting system of claim 10, wherein each of the plurality of wireless capable light fixtures further comprise a power supply, a light source, a sensor, and a processor.

* * * * *